US006585220B1

(12) United States Patent
Shemuga

(10) Patent No.: US 6,585,220 B1
(45) Date of Patent: Jul. 1, 2003

(54) SUPPORT APPARATUS FOR ROLLOUT AWNINGS

(76) Inventor: Daniel T. Shemuga, 464 Eckard Ave., Akron, OH (US) 44314

( * ) Notice: Subject to any disclaimer, the term of this patent is extended or adjusted under 35 U.S.C. 154(b) by 0 days.

(21) Appl. No.: 09/685,955

(22) Filed: Oct. 11, 2000

(51) Int. Cl.[7] ..... E04H 15/62; E04F 10/00

(52) U.S. Cl. ..... 248/535; 248/346.07; 135/118; 160/46; 403/109.3

(58) Field of Search ..... 248/519, 523, 248/534, 535, 530, 532, 533, 156, 298.1, 346.07, 670, 408, 505, 508; 52/74; 160/46; 403/109.2, 109.3; 135/116, 118

(56) References Cited

U.S. PATENT DOCUMENTS 1,555,322 A * 9/1925 Kleinhesselink ..... 135/118
1,958,716 A * 5/1934 Roach et al. ..... 248/156
2,808,065 A * 10/1957 Ellis ..... 135/123
3,310,266 A * 3/1967 Larkin et al. ..... 248/154
3,599,917 A * 8/1971 Schwartz ..... 248/87
3,720,438 A * 3/1973 Johnson et al. ..... 135/88.1
3,785,606 A * 1/1974 Green ..... 249/170
3,996,708 A * 12/1976 Frye ..... 52/157
4,040,214 A * 8/1977 Frye ..... 52/157
4,343,449 A * 8/1982 Osthus ..... 248/156
4,577,837 A * 3/1986 Berg et al. ..... 254/212
4,756,128 A * 7/1988 Danieli ..... 52/156
4,782,846 A * 11/1988 Ting ..... 135/120
4,793,371 A * 12/1988 O'Ferrell et al. ..... 135/118
4,829,732 A * 5/1989 Dahowski et al. ..... 52/298
5,002,252 A * 3/1991 Setala et al. ..... 248/523
5,054,579 A * 10/1991 Moson ..... 182/107
5,499,691 A * 3/1996 Fitzpatrick ..... 182/107
5,556,064 A * 9/1996 Cowe ..... 248/172
5,615,699 A * 4/1997 Lee ..... 135/118
5,740,827 A * 4/1998 Swarringim ..... 135/118
5,937,452 A * 8/1999 Brewer ..... 4/460

* cited by examiner

*Primary Examiner*—Ramon O. Ramirez
*Assistant Examiner*—Jon Szumny
(74) *Attorney, Agent, or Firm*—John D. Gugliotta; P. Jeff Martin

(57) ABSTRACT

A support apparatus for rollout awnings is provided for stabilizing the support legs of an awning for recreational vehicles, mobile homes and campers. A pair of post stabilizing members includes an inner member telescoping inside an outer member for varying the length of each post stabilizing member. The inner member and the outer member are of a linearly elongated cylindrical configuration. An L-shaped stake is positioned transversely and perpendicularly along the centerline of each post stabilizing member.

4 Claims, 3 Drawing Sheets

SUPPORT APPARATUS FOR ROLLOUT AWNINGS

RELATED APPLICATIONS

The present invention was first described in Disclosure Document No. 470,981 filed on Mar. 17, 2000. There are no previously filed, nor currently any co-pending applications, anywhere in the world.

BACKGROUND OF THE INVENTION

1. Field of the Invention

The present invention relates generally to awnings and, more particularly, to a support apparatus for rollout awnings.

2. Description of the Related Art

Millions of Americans enjoy camping and traveling as their preferred leisure time activity. Among these avid campers, a great deal choose to do so in recreational vehicles that range in size from small pop-up campers that are designed to be towed behind a car or truck to large motorized RV's with integral engines. A common accessory that may be found on all of these RV's is a rollout awning. These awnings are attached to the RV near the roof line and roll out to form an awning that provides protection from the sun, rain and other elements. People may then sit under these awnings to eat, relax, visit, and the like. These awnings are supported and secured at their outside corners by posts and tie down ropes. However, these posts and ropes are subject to being easily dislodged by strong winds, people that do not see them and walk into them, pets, and young children who may be running through the area.

A search of the prior art did not disclose any patents that read directly on the claims of the instant invention; however, the following references were considered related. The following patents disclose an awning assembly with stowable support arms: U.S. Pat. No. 5,636,675 issued in the name of Baka et al.; U.S. Pat. No. 5,622,214 issued in the name of Baka et al.

The following patents describe an awning assembly with telescopic support arms or legs: U.S. Pat. No. 4,719,954 issued in the name of Curtis et al.; U.S. Pat. No. 4,640,332 issued in the name of Turner, and U.S. Pat. No. 4,117,876 issued in the name of Bennett.

U.S. Pat. No. 4,821,987 issued in the name of Haman discloses a recreational vehicle awning support truss and system.

U.S. Pat. No. 4,727,897 issued in the name of Watts describes a stabilizing bracket for an awning of a recreational vehicle.

U.S. Pat. No. 4,411,109 issued in the name of Struben et al. discloses a beam-braced awning.

U.S. Pat. No. D 312,771 issued in the name of Pelletier describes the ornamental design for a recreational vehicle awning support adapter.

Consequently, a need has been felt for providing a rigid support apparatus for rollout awnings used on recreational vehicles, mobile homes and campers which can be secured in a manner which is quick, easy and effective.

SUMMARY OF THE INVENTION

Therefore, it is an object of the present invention to provide a sturdy and rigid support apparatus for rollout awnings used on recreational vehicles, mobile homes, campers and the like which prevents accidental movement by children, pets and high winds.

It is another object of the present invention to provide an awning support apparatus which can secure rollout awnings in a quick, easy and effective manner.

Briefly described according to one embodiment of the present invention, a support apparatus for rollout awnings is provided to aid in holding and stabilizing awning post as used on recreational vehicles, mobile homes, campers and the like. The present invention is designed for use with rollout awnings being supported by awning posts.

To use the present invention, the awning is deployed in the customary manner and the awning support posts are placed at the two outward corners of the awning. The awning posts are then placed into a post holder mounted at one end of an elongated pipe which utilizes an eyelet mounted at the other. The elongated pipe measures approximately 14 inches in length but can be varied in length to suit the awning size by a telescoping mechanism.

Next, an awning rope is secured to the eyelet. This forms a triangular support mechanism that is rigid and strong without having to rely on the earth or dirt for strength.

The present invention further utilizes an L-shaped hook which is driven in an inverted manner into the earth after being placed across the middle of the elongated pipe. This functions to hold the invention in place and to prevent it from becoming accidentally moved.

The use of the present invention allows recreational vehicle, mobile home and camper owners the ability to use their awnings without risk or fear of the awning accidentally becoming dislodged by children, pets, or high winds.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
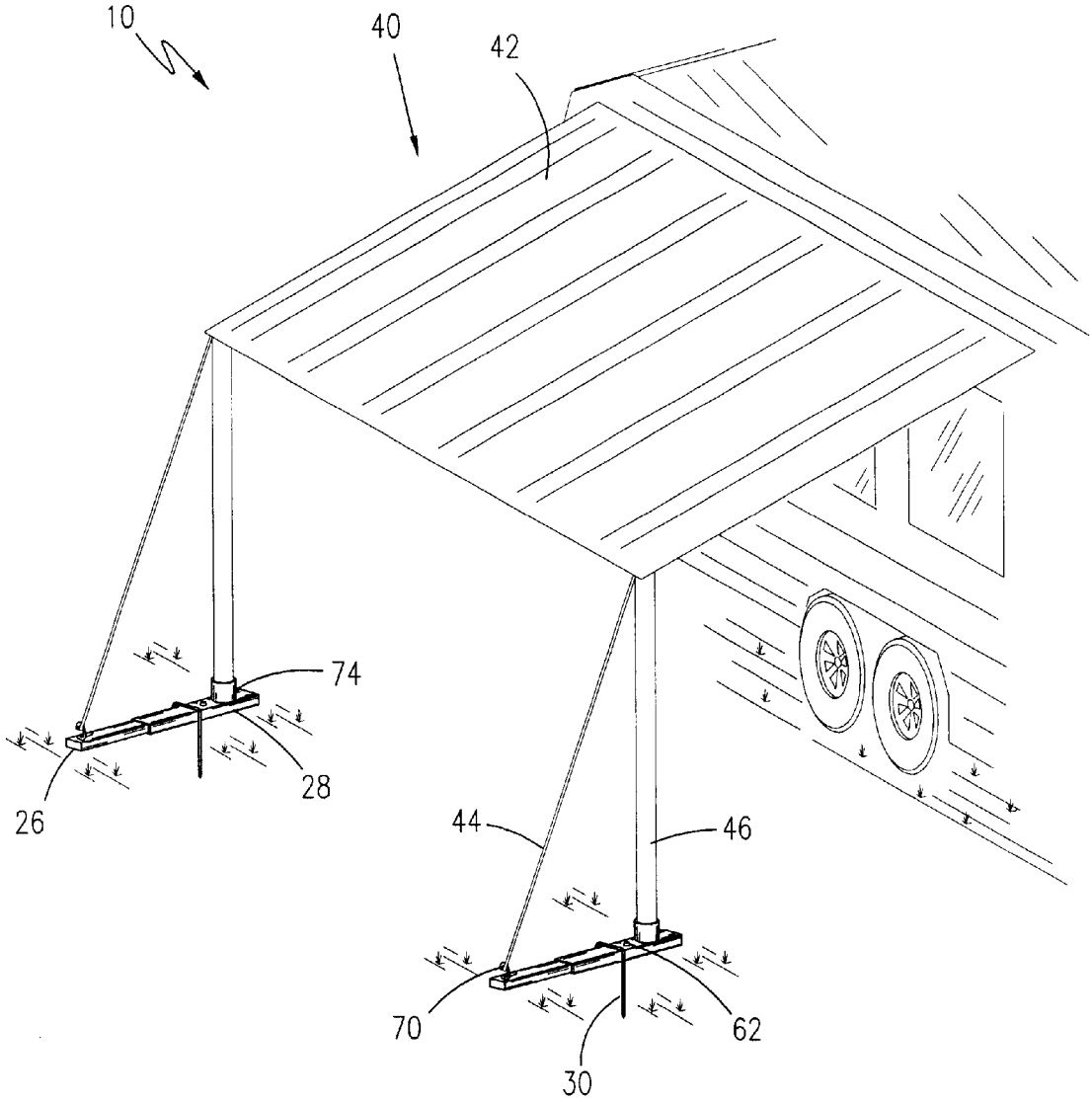
FIG. 1 is a perspective view of a support apparatus for rollout awnings according to the preferred embodiment of the present invention.
Figure 2:
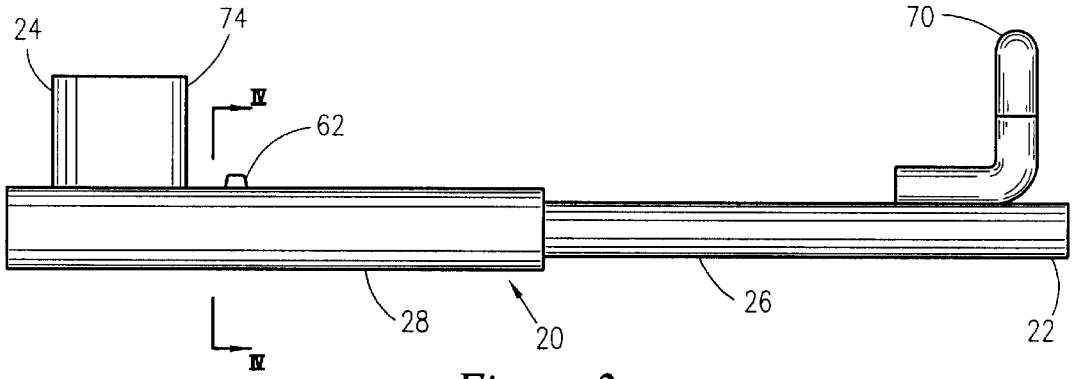
FIG. 2 is a side elevational view of a post stabilizing member according to the preferred embodiment of the present invention.
Figure 4:
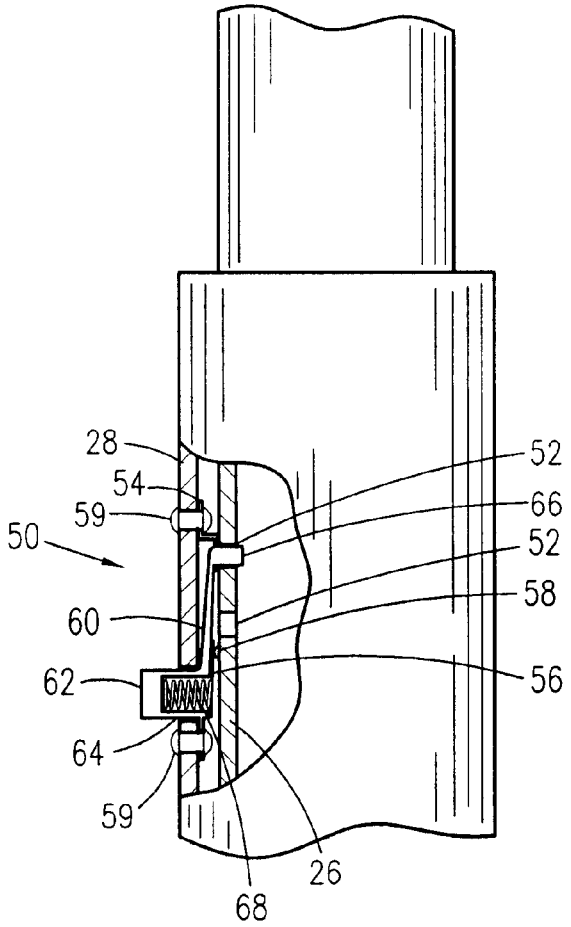
FIG. 4 is a cross-sectional view of a button assembly taken along lines IV—IV of FIG. 2 according to the preferred embodiment of the present invention.
Figure 5:
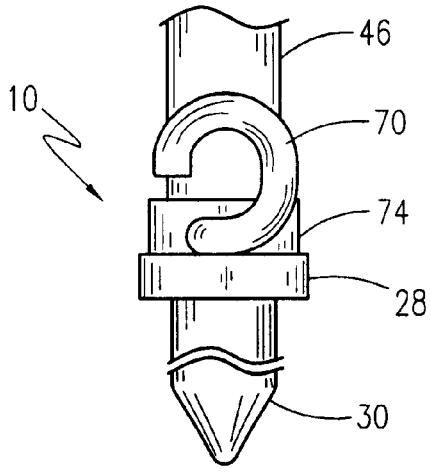
FIG. 5 is a front end elevational view according to an alternate embodiment of the present invention.

Referring now to FIGS. 1, 2 and 4, a support apparatus for rollout awnings 10 is shown, according to the present invention, comprised of at least one pair of post stabilizing members 20 having an anterior end 22 opposite a posterior end 24 and an L-shaped stake 30 having a first portion 32 and a second portion 34 for securing and stabilizing rollout awnings used on recreational vehicles, mobile homes, campers and the like.

For purposes of this disclosure, the present invention is to be utilized with a conventional rollout awning 40 comprising an awning 42 made from vinyl, canvas, or other materials as is known in the art with outer edges having an awning rope 44 securely fastened at the corners thereof and a pair of awning support posts 46.

Each of the pair of post stabilizing members 20 includes an inner member 26 telescoping inside an outer member 28 for varying the length of each post stabilizing member 20. The inner member 26 and the outer member 28 are of a linearly elongated cylindrical configuration being preferably constructed of stainless steel; however, the inner members 26 and the outer members 28 may also be constructed of high-strength, lightweight material such as aluminum.

Once the desired length of the post stabilizing member 20 has been provided, the inner member 26 and the outer member 28 can be held into a user selected position via a button assembly 50. The button assembly 50 is designed so as to cooperate with a plurality of holes 52 aligned along a length of the inner member 26.

The button assembly 50 includes a button retainer 54 with a spring support 56 and a pivot mound 58. The button retainer 54 is securely fastened to the outer member 28 by a pair of rivets 59.

A locking arm 60, having a button 62 located at one end which extends through a hole 64 in the outer member 28 and a lock pin 66 at an opposite end, forms a lever.

Pressure exerted on the button 62 actuates the locking arm 60 to pivot about the mound 58 thereby removing the lock pin 66 from the holes 52 along the length of the inner member 26.

A spring 68 is disposed on the spring support 56 so as to bias the button 62 to a locking position. It is envisioned that each post stabilizing member 20 would be capable of extending a length of approximately 14 inches.

Referring now to FIG. 2, an eyelet 70 is welded to the inner member 26 at the anterior end 22 of each of the post stabilizing members 20 for securely attaching an awning rope 44 thereto. The eyelet 70 may also be bolted or clamped to the inner member 26; however, welding is the preferred method for permanent attachment. As bolts require holes, this method of attachment will leave surfaces exposed thereby being more susceptible to rust.

To accommodate accepting a pair of awning support posts 46, a post receiving shoe 74 is welded to the outer member 28 below the button retainer 54 at the posterior end 24 of each of the post stabilizing members 20.

Each of the pair of post receiving shoes 74 is of a cylindrical configuration preferably constructed of stainless steel and is designed so as to removably receive an awning support post 46. Alternatively, the post receiving shoes 74 may be constructed of high-strength, lightweight material such as aluminum.

It is envisioned that each post receiving shoe 74 measures approximately 2 inches in length.

At this point, a user may securely fasten an awning rope 44 to each eyelet 70 on each inner member 26 forming a triangular support mechanism being rigid and strong which doesn't rely on the earth for strength.

Figure 3:
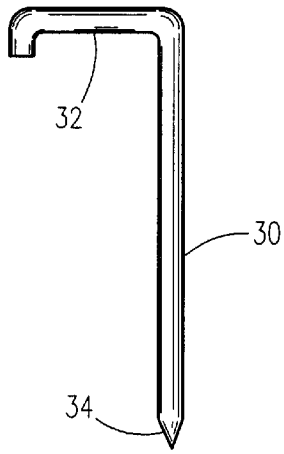
FIG. 3 is a side elevational view of a stake according to the preferred embodiment to the present invention.

Referring now to FIG. 3, in order to securely hold each post stabilizing member 20 in place and to prevent them from becoming accidentally moved, the first portion 32 of the L-shaped stake 30 is positioned transversely and perpendicularly along a linearly elongated centerline of each post stabilizing member 20, while the second portion 34 of the stake 30 is driven into the ground at a depth measuring approximately 10 inches.

It is envisioned that the post stabilizing members 20, the post receiving shoes 74, and the stakes 30 could be formed in other cross-sectional shapes, such as square or hexagonal without departing from the scope or spirit of the present invention.

Once assembled, the present invention provides a sturdy and rigid support apparatus for rollout awnings 40 which prevents accidental movement by children, pets and high winds.

2. Operation of the Preferred Embodiment

To use the present invention, the user deploys the awning 42 in the customary manner and the pair of awning support posts 46 are secured at the two outward corners of the awning 42. A lower end of each awning post 46 is then placed into its respective post receiving shoe 74 which is welded at the posterior end 24 of each of the post stabilizing members 20. Each post stabilizing member 20 measures approximately 14 inches in length but can be varied in length to suit the awning 42 size by telescopic adjustment.

Next, the awning rope 44 is secured to the eyelet 70. This forms a triangular support mechanism that is rigid and strong without having to rely on the earth or dirt for strength. For additional stability, the first portion 32 of the L-shaped hook is then placed transversely and perpendicularly along a linearly elongated centerline of each post stabilizing member 20, while the second portion 34 of the stake 30 is driven into the ground at a depth measuring approximately 10 inches. This functions to hold the present invention in place and to prevent it from becoming accidentally moved.

The use of the present invention allows recreational vehicle, mobile home and camper owners the ability to use their awnings without risk or fear of the awning accidentally becoming dislodged by children, pets, or high winds.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A support apparatus for rollout awnings comprising:

at least one pair of post stabilizing members, each said post stabilizing member having an anterior end opposite a posterior end and an L-shaped stake having a first portion and a second portion, for securing and stabilizing a conventional rollout awning comprising an awning made from vinyl, canvas, or other suitable textiles with outer edges having an awning rope securely fastened at the corners thereof and a pair of awning support posts;

an inner member telescoping inside an outer member for varying the length of each said post stabilizing member, wherein said inner member and said outer member are held into a user selected position via a button assembly, said button assembly designed so as to cooperate with a plurality of holes aligned along a length of the inner member;

a button retainer with a spring support and a pivot mound, said button retainer securely fastened to said outer member; and a pair of post receiving shoes, wherein one of the shoes of the pair of post receiving shoes is welded to the outer member of one of the post stabilizing members and the other of the shoes of the pair of post receiving shoes is welded to the outer member of the other post stabilizing member.

2. The support apparatus for rollout awnings of claim 1, further comprising an eyelet terminating one said post stabilizing member at said anterior end for securely attaching an awning rope thereto.

3. The support apparatus for rollout awnings of claim 1, wherein each of the pair of post receiving shoes is of a cylindrical configuration so as to removably receive an awning support post.

4. The support apparatus for rollout awnings of claim 1, wherein each post receiving shoe measures approximately 2 inches in length.

* * * * *